US007641443B2

(12) United States Patent
Chuang

(10) Patent No.: US 7,641,443 B2
(45) Date of Patent: Jan. 5, 2010

(54) ASSEMBLING MEMBER AND HEAT-DISSIPATING MODULE HAVING ASSEMBLING MEMBER

(75) Inventor: Chih-Peng Chuang, Taipei (TW)

(73) Assignee: Inventec Corporation, Taipei (TW)

( * ) Notice: Subject to any disclaimer, the term of this patent is extended or adjusted under 35 U.S.C. 154(b) by 472 days.

(21) Appl. No.: 11/586,224

(22) Filed: Oct. 24, 2006

(65) Prior Publication Data

US 2008/0095619 A1 Apr. 24, 2008

(51) Int. Cl.
*F04D 29/52* (2006.01)

(52) U.S. Cl. ..... 415/213.1; 417/423.14

(58) Field of Classification Search ..... 415/213.1, 415/220; 361/695; 417/423.14
See application file for complete search history.

(56) References Cited

U.S. PATENT DOCUMENTS 6,592,327 B2 * 7/2003 Chen et al. ..... 415/213.1
6,921,247 B2 * 7/2005 Stewart et al. ..... 415/213.1
7,048,498 B2 * 5/2006 Kosugi ..... 415/118
7,145,771 B2 * 12/2006 Wang ..... 361/695
2008/0075589 A1 * 3/2008 Chen et al. ..... 415/213.1

* cited by examiner

*Primary Examiner*—Ninh H Nguyen
(74) *Attorney, Agent, or Firm*—Peter F. Corless; Steven M. Jensen; Edwards Angell Palmer & Dodge LLP

(57) ABSTRACT

An assembling member and a heat-dissipating module having the assembling member are proposed. The assembling member connects a fan having at least a receiving space and a plurality of first positioning portions to an electronic host housing having a plurality of first fixing portions. The assembling member includes a main body for being accommodated into the receiving space, a plurality of first coupling portions for coupling with the first positioning portions, an elastic portion disposed at one side of the main body, and a plurality of first engaging portions for engaging with the first fixing portions. The first engaging portions are connected to the elastic portions, such that the first engaging portions can be urged by the elastic portions of the assembling member to engage with the first fixing portions. The heat-dissipating module of the present invention is easy to assemble and disassemble, has simple structure and low cost.

5 Claims, 6 Drawing Sheets

ASSEMBLING MEMBER AND HEAT-DISSIPATING MODULE HAVING ASSEMBLING MEMBER

BACKGROUND OF THE INVENTION

1. Field of the Invention

The present invention relates generally to fixing technology, and more particularly to an assembling member that can be fixed to an electronic host housing and a heat-dissipating module that has the assembling member.

2. Description of Related Art

With development of science and technology, along with development of information communication, computers are becoming a necessity in our daily life, which are crowded with more and more electronic components to meet demands for high processing speed and high integration. Accordingly, at least a heat-dissipating fan is disposed inside a computer such as a server for dissipating heat generated by electronic components of the computer such as CPU and hard disk during operation, thereby avoiding malfunction of the computer.

To fix a heat-dissipating fan inside a host housing of a server or a hard disk, a screw fixing method is usually used, which however not only needs a large amount of screws but also needs additional tools such as a screwdriver to tighten or loosen the screws. If the heat-dissipating fan needs to be removed from the host housing for troubleshooting or replacement, additional tools also need to be used for removing the fan from the host housing. Therefore, such a screw fixing method is rather inconvenient and can adversely affect production of servers or hard disks and decrease maintenance efficiency.

Accordingly, Taiwanese Publication No. 200521336 and US Patent Publication No. 2006/0099092 disclose heat-dissipating fan fixing techniques without using the screw fixing method. FIG. 1 is an exploded view of a heat-dissipating fan module disclosed by Taiwanese Publication No. 200521336.

As shown in FIG. 1, the heat-dissipating fan module comprises an assembling member 100 and a fan 200. The assembling member 100 comprises a top portion 101, two side portions 102 extending at a certain angle from the top portion 101, holding rings 103 disposed on two sides of the top portion 101, elastic sheets 104 connected with the holding rings 103, tenons 105 disposed on the elastic sheets 104, and a plurality of connecting holes 106 disposed on inner sides of the two side portions 102 corresponding to fixing holes 201 of the fan 200.

By closely attaching the assembling member 100 to a side surface of the fan 200 and connecting the connecting holes 106 to the corresponding fixing holes 201 through rivets, the assembling member 100 can be fixed to the fan 200 so as to form a heat-dissipating fan module. Then, the heat-dissipating fan module is laterally disposed inside a host housing with the tenons 105 engaging with the host housing. When a user uses fingers inserting the holding rings 103, then applies a force in a direction toward the top portion 101 of the assembling member 100, because the elastic sheets 104 of the assembling member 100 have elasticity, the holding rings 103 move toward the top portion 101, causing tenons 105 disposed on the elastic sheets 104 to separate from the host housing. As a result, the fan 200 is removed from the host housing.

Although such a fixing technique eliminates the need of any additional tools, it has some drawbacks. For example, the plurality of rivets used to fix the assembling member 100 to the fan 200 increases the material cost and increases assembly and disassembly time of the assembling member 100. Meanwhile, the attaching of the assembling member to the fan increases the volume of the heat-dissipating fan module. In addition, a space needs to be reserved for allowing a force to be applied on the holding rings so as to remove the heat-dissipating module from the host housing, which thus decreases the design flexibility.

Therefore, there is a need to provide a heat-dissipating module fixing technique overcoming the above drawbacks.

SUMMARY OF THE INVENTION

According to the above drawbacks, an objective of the present invention is to provide an assembling member and a heat-dissipating module having the assembling member, which can be easily and quickly assembled and disassembled without the need of any tools.

Another objective of the present invention is to provide an assembling member and a heat-dissipating module having the assembling member, which saves components compared with the prior art.

A further objective of the present invention is to provide an assembling member and a heat-dissipating module having the assembling member, which provides design flexibility.

In order to attain the above and other objectives, an assembling member and a heat-dissipating module having the assembling member are proposed.

The assembling member of the present invention is used for connecting a fan having at least a receiving space and a plurality of first positioning portions to a host housing having a plurality of first fixing portions. The assembling member includes a main body for being accommodated into the receiving space of the fan, a plurality of first coupling portions disposed at one end of the main body for coupling with the first positioning portions of the fan, an elastic portion disposed at one side of the main body, and a plurality of first engaging portions for engaging with the first fixing portions of the host housing, wherein the first engaging portions are connected to the elastic portions such that the first engaging portions can be urged by the elastic portions of the assembling member to engage with the first fixing portions of the host housing. Preferably, the assembling member is made of an elastic material such as plastic. The main body of the assembling member is composed of two symmetrical columns, and correspondingly, the receiving space is composed of two symmetrical receiving spaces. The first positioning portions may be through holes. The first coupling portions may be pins. Preferably, a holder is disposed at one side of the elastic portion of the assembling member such that a user can hold the holder and apply a force thereon, thereby causing the first engaging portions connected to the elastic portion of the assembling member to move. The first engaging portions comprise a latch.

The heat-dissipating module of the present invention can be applied in a host housing having at least a limiting portion and a plurality of first fixing portions, which comprises a fan having a plurality of first positioning portions and at least a receiving space formed at one side of the fan; and an assembling member comprising a main body for accommodating into the receiving space of the fan, a plurality of first coupling portions disposed at one end of the main body for coupling with the first positioning portions of the fan, an elastic portion disposed at one side of the main body, and a plurality of first engaging portions for engaging with the first fixing portions of the host housing, wherein the first engaging portions are connected to the elastic portions such that the first engaging portions can be urged by the elastic portions of the assembling member to engage with the first fixing portions of the host housing. Preferably, the heat-dissipating module has same size as the limiting portion of the host housing. The fan also has same size as the limiting portion.

In a preferred embodiment, the heat-dissipating module further comprises a fan cover disposed at a ventilation side of the fan, and a power fixing structure disposed at the other side of the fan. The fan cover has second positioning portions corresponding to the first positioning portions at the ventilation side of the fan. The power fixing structure has third positioning portions disposed at the other ventilation side of the fan, that is, disposed away from the fan cover, and fourth positioning portions for fixing a power connector.

Therefore, according to the heat-dissipating member and the heat-dissipating module of the present invention, a fan can easily and quickly be assembled to or disassembled from the host housing by elastic force of the assembling member without the need of any additional components and tools. Thus, the conventional drawbacks caused by the screw fixing method are overcome, and accordingly time and cost are saved.

Meanwhile, as the assembling member of the present invention is fixed to the fan by the first coupling portions such as pins, the need for additional components such as rivets in the prior art is eliminated. As a result, the cost is reduced. Moreover, as the size of the fan is kept same after the assembling member is received in the receiving space of the fan instead of being attached to the surface of the fan as in the conventional art, the design flexibility is increased.

DETAILED DESCRIPTION OF PREFERRED EMBODIMENTS

The following illustrative embodiments are provided to illustrate the disclosure of the present invention, these and other advantages and effects can be apparent to those skilled in the art after reading the disclosure of this specification. The present invention can also be performed or applied by other different embodiments. The details of the specification may be on the basis of different points and applications, and numerous modifications and variations can be made without departing from the spirit of the present invention.

First Embodiment

Figure 1:
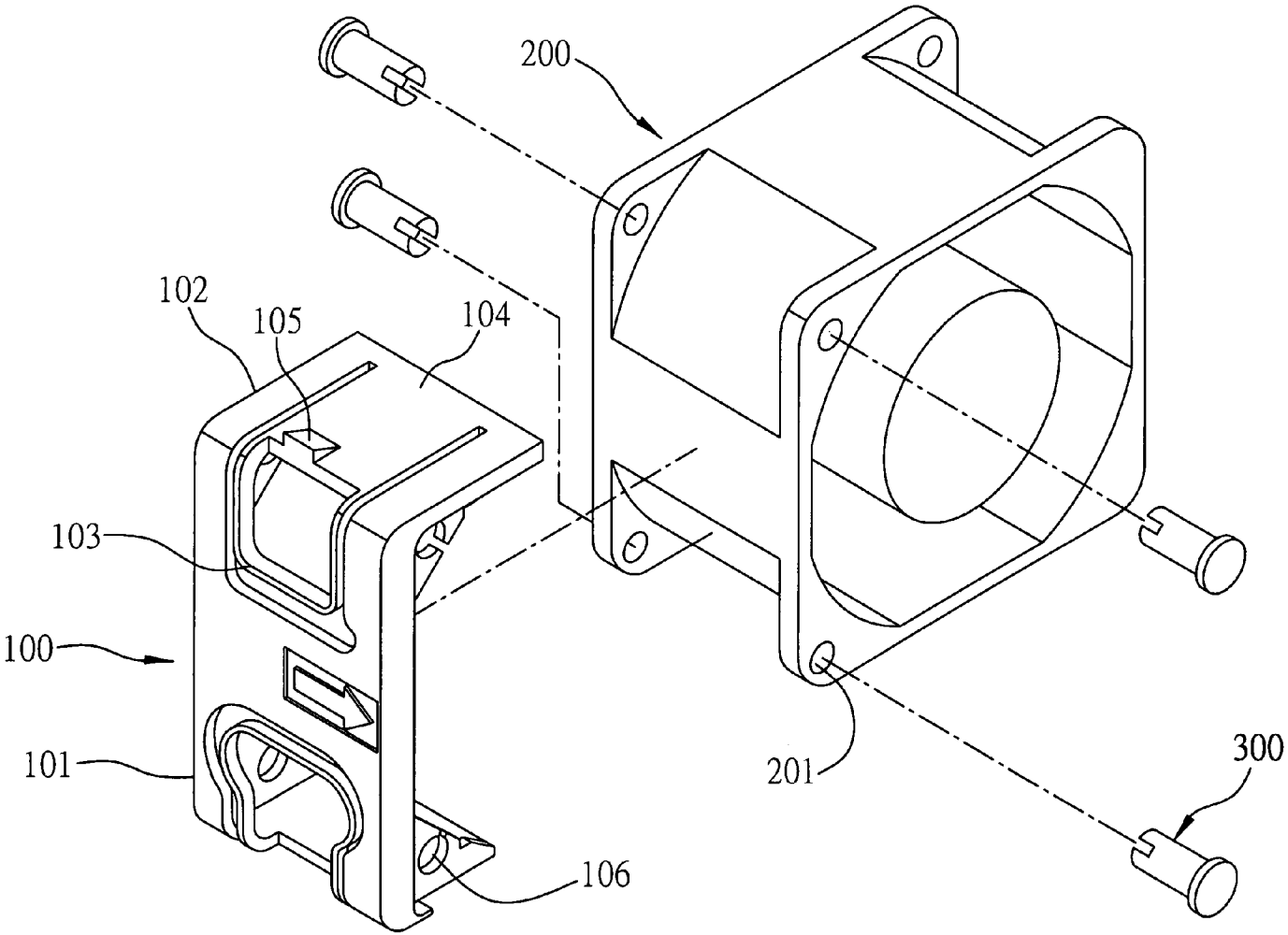
FIG. 1 (PRIOR ART)
FIG. 1 is an exploded diagram of a heat-dissipating fan module of the prior art.
Figure 2:
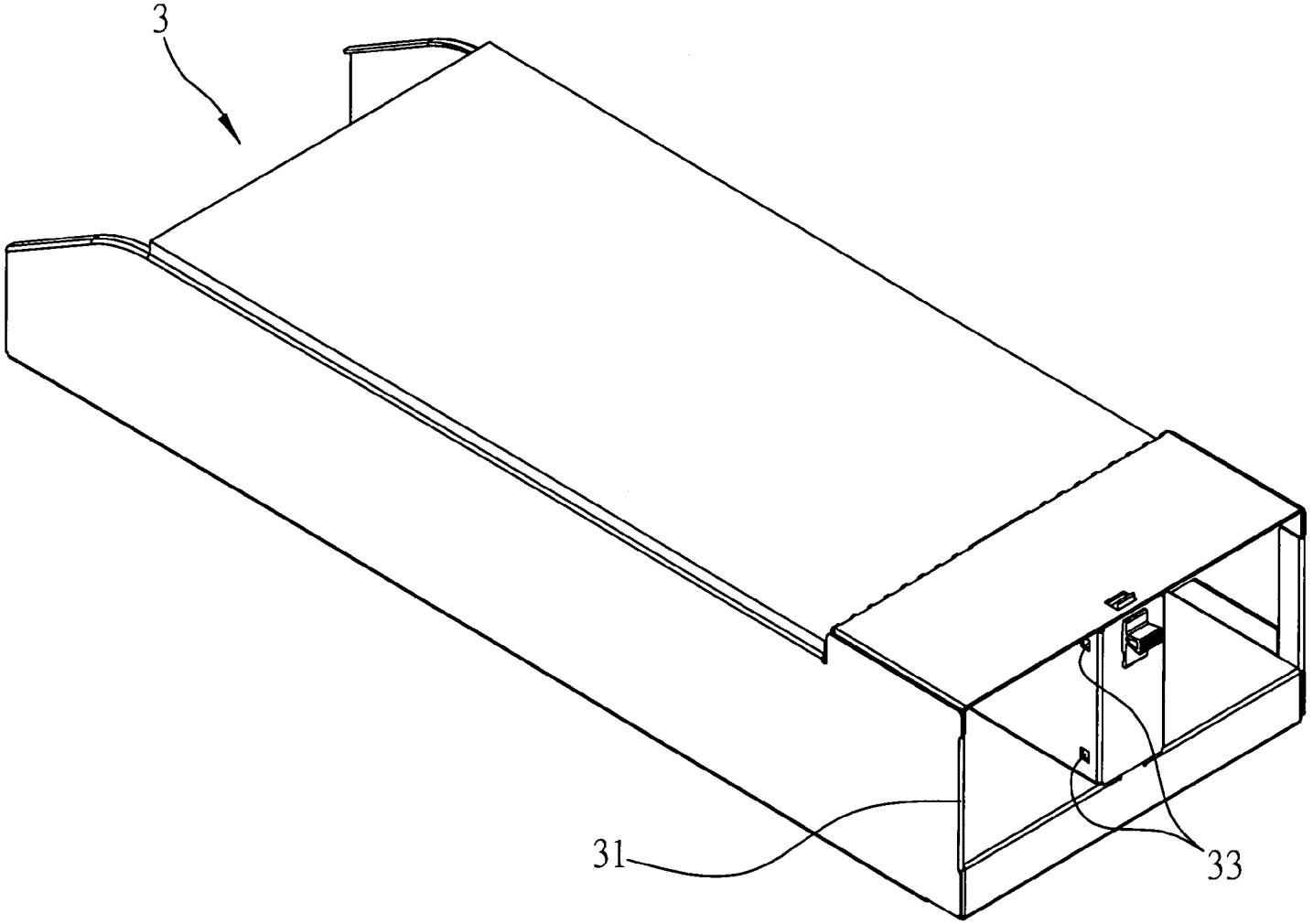
FIG. 2 is a diagram of a host housing to which the present invention can be applied.
Figure 3B:
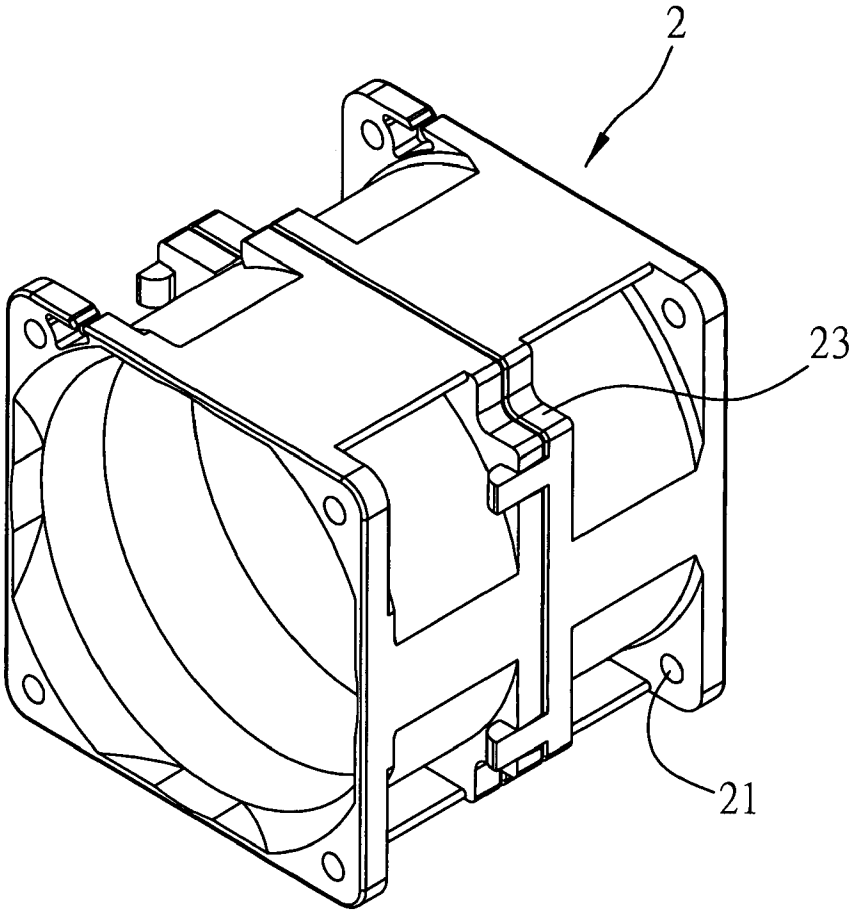
FIG. 3B is a diagram of a fan.
Figure 3A:
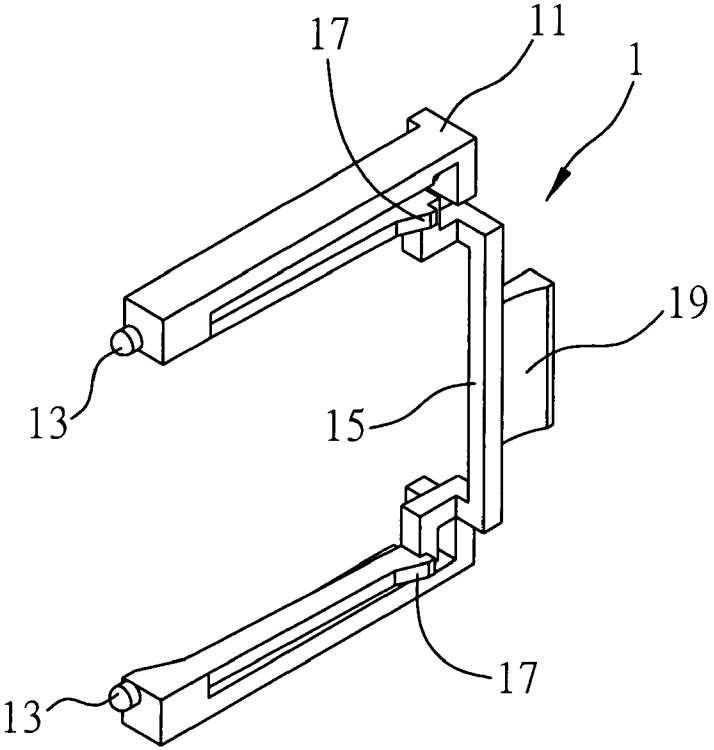
FIG. 3A is a diagram of an assembling member of the present invention.
Figure 4:
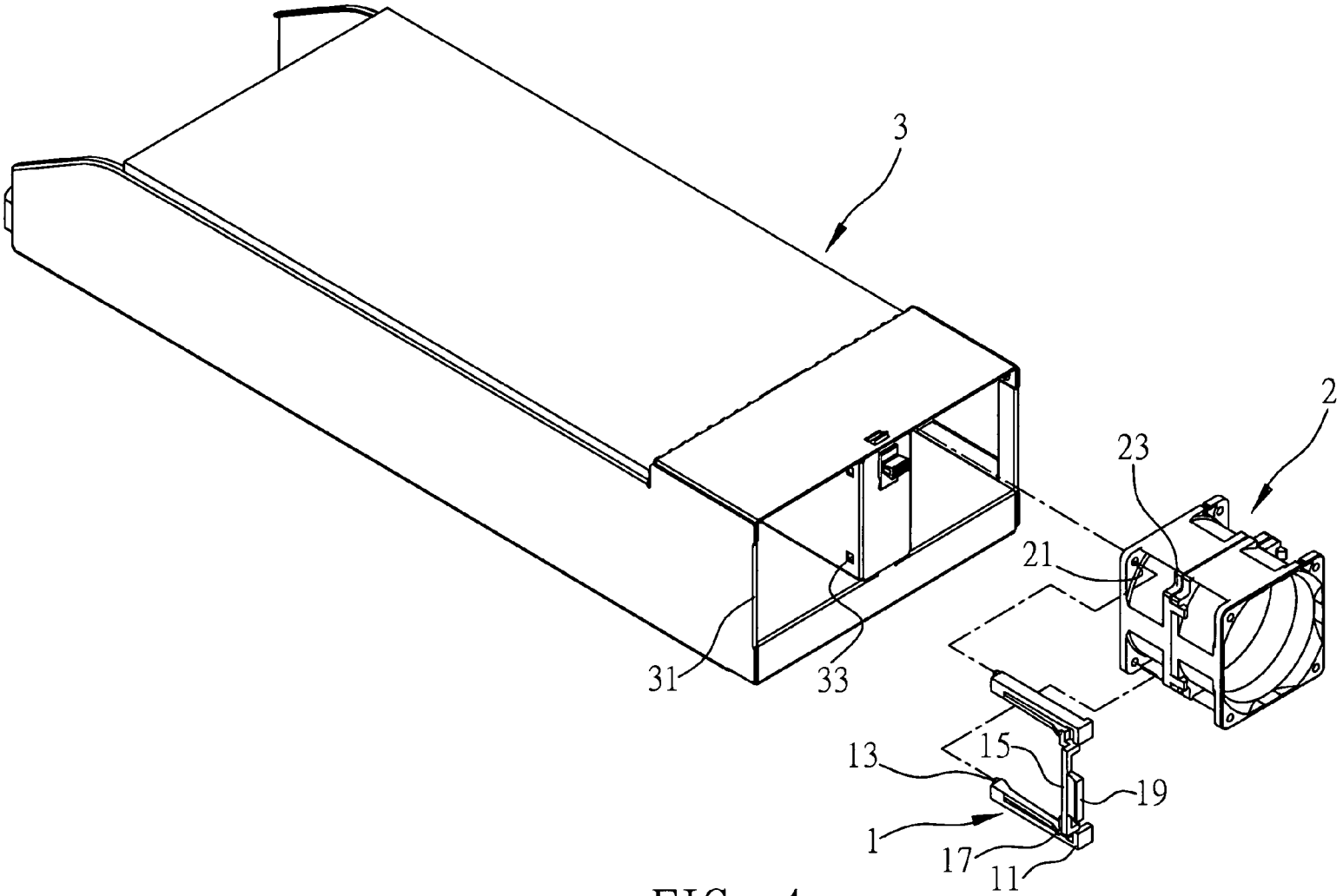
FIG. 4 shows an assembling state of the assembling member, the fan and the host housing according to a first embodiment of the present invention.

FIGS. 2 to 4 show an assembling member 1 and a heat-dissipating module having the assembling member 1 of a first embodiment according to the present invention. FIG. 2 shows a diagram of a host housing 3 to which the assembling member 1 and the heat-dissipating module having the assembling member 1 and a fan 2 are applied. FIG. 3A is a schematic diagram of the assembling member 1. FIG. 3B is a schematic diagram of the fan 2. FIG. 4 shows an assembling state of the assembling member 1, the fan 2 and the host housing 3 of the first embodiment according to the present invention.

As shown in FIG. 2, the host housing 3 comprises at least a limiting portion 31 and a plurality of first fixing portions 33. As shown in FIGS. 3A and 3B, the heat-dissipating module of the present invention comprises the assembling member 1 and a fan 2 having at least a receiving space 23 and a plurality of first positioning portions 21. In the first embodiment, the heat-dissipating module is longitudinally disposed inside the host housing 3, wherein the fan 2 of the heat-dissipating module is fixed inside the host housing 3 through the assembling member 1 of the heat-dissipating module.

But it should be noted that the application of the assembling member and the heat-dissipating module of the present invention is not limited to the present embodiment. The assembling member and the heat-dissipating module of the present invention can also be applied to other electronic host housings such as servers, hard disks, heat-dissipating devices and so on.

Referring to FIGS. 2 and 3B, the limiting portion 31 of the host housing 3 is formed in shape corresponding to the fan 2 so as to ensure air-stream guided from the fan 2 flows to predefined areas. In the first embodiment, the limiting portion 31 of the host housing 3 has a rectangular cross section and is in structure corresponding to the fan 2, but those skilled in the art will understand that the shape and size of the limiting portion 31 can be changed according to the casing structure of the fan 2 as long as the limiting portion 31 can ensure the air-stream of the fan 2 flows to predefined areas. In the present embodiment, the host housing 3 can receive two fans 2, but it is not limited thereto. As two fans can be disposed inside the host housing in a same way, the present embodiment only illustrates how to dispose one of the fans 2 inside the host housing 3 so as to make the characteristic of the present invention much more clear.

Referring to FIG. 3A, the assembling member 1 comprises a main body 11 for being accommodated into the receiving space 23 of the fan 2, a plurality of first coupling portions 13 disposed at one end of the main body 11 for coupling with the first positioning portions 21 of the fan 2, an elastic portion 15 disposed at one side of the main body 11, and a plurality of first engaging portions 17 for engaging with the first fixing portions 33 of the host housing 3. The first engaging portions 17 are connected to the elastic portions 15 such that the first engaging portions 17 can be urged by the elastic portions 15 to engage with the first fixing portions 33 of the host housing 33. The assembling member 1 can be made of a plastic material. The first coupling portions 13 can be made of pins. A holder 19 is further disposed on the elastic portion 15 such that the elastic portion 15 can easily be moved so as to urge the first engaging portions 17 to engage with or separate from the first fixing portions 33 of the host housing 3. The first engaging portions 17 can be latches and correspondingly, the first fixing portions 33 of the host housing 3 can be through holes.

A step difference is formed between an extension end of the elastic portion 15 and the main body 11 of the assembling member 1. The first engaging portions 17 are connected to the elastic portion 15 and extend outwardly. The first engaging portions can be made of protruding ribs, latches or the like.

Preferably, the receiving space 23 of the fan 2 is integrally formed with the fan 2. Meanwhile, the receiving space 23 allows the main body 11 of the assembling member 1 to be received therein without changing the initial shape and size of the fan 2. The receiving space 23 can be made up of two symmetrical receiving spaces respectively corresponding to the two symmetrical columns of the main body 11.

It should be noted that the first coupling portions 13 of the assembling member 1 are disposed in position corresponding to the first positioning portions 21 of the fan 2. Although the first coupling portions 13 are made of pins corresponding to the first positioning portions 21 of through holes, those skilled in the art will understand the number and structure of the first coupling portions 13 are not limited to the present embodiment.

As shown in FIG. 4, to assemble the assembling member 1 and the fan 2 to the host housing 3, first, the first coupling portions 13 of the assembling member 1 are fixed to the first positioning portions 21 of the fan 2 and the main body 11 of the assembling member is received in the receiving space 23 of the fan 2. Then, the holder 19 is held and a force is applied thereto so as to cause the elastic portion 15 connected to the holder 19 to move toward the fan 2, thereby accumulating resilient force during the movement. Then, the fan 2 is longitudinally disposed in the limiting portion 31 of the host housing 3. After the applied force is released, the resilient force of the elastic portion 15 urges the first engaging portions 17 of the assembling member 1 to engage with the first fixing portions 33 of the host housing 3.

To disassemble the fan 2 from the host housing 3, the holder 19 is held again and a force is applied on the holder 19 in a direction toward the fan 2. As a result, the first engaging portions 17 are separated from the first fixing portions 33 of the host housing 3, thereby removing the fan 2 from the host housing 3.

Thus, the fan 2 can easily and quickly be assembled to or disassembled from the host housing 3 through elastic force of the assembling member 1 without the need of any tools.

Meanwhile, the assembling member of the present invention is fixed to the fan through the first coupling portions such as pins, which thus eliminates the need for additional components such as rivets in the prior art. As a result, the cost is reduced. Further, the fan can easily and conveniently be assembled to or disassembled from the host housing only by exerting little force on the assembling member. Moreover, the size of the fan is kept same after the assembling member is fixed to the fan, thereby increasing the design flexibility.

Second Embodiment

Figure 5:
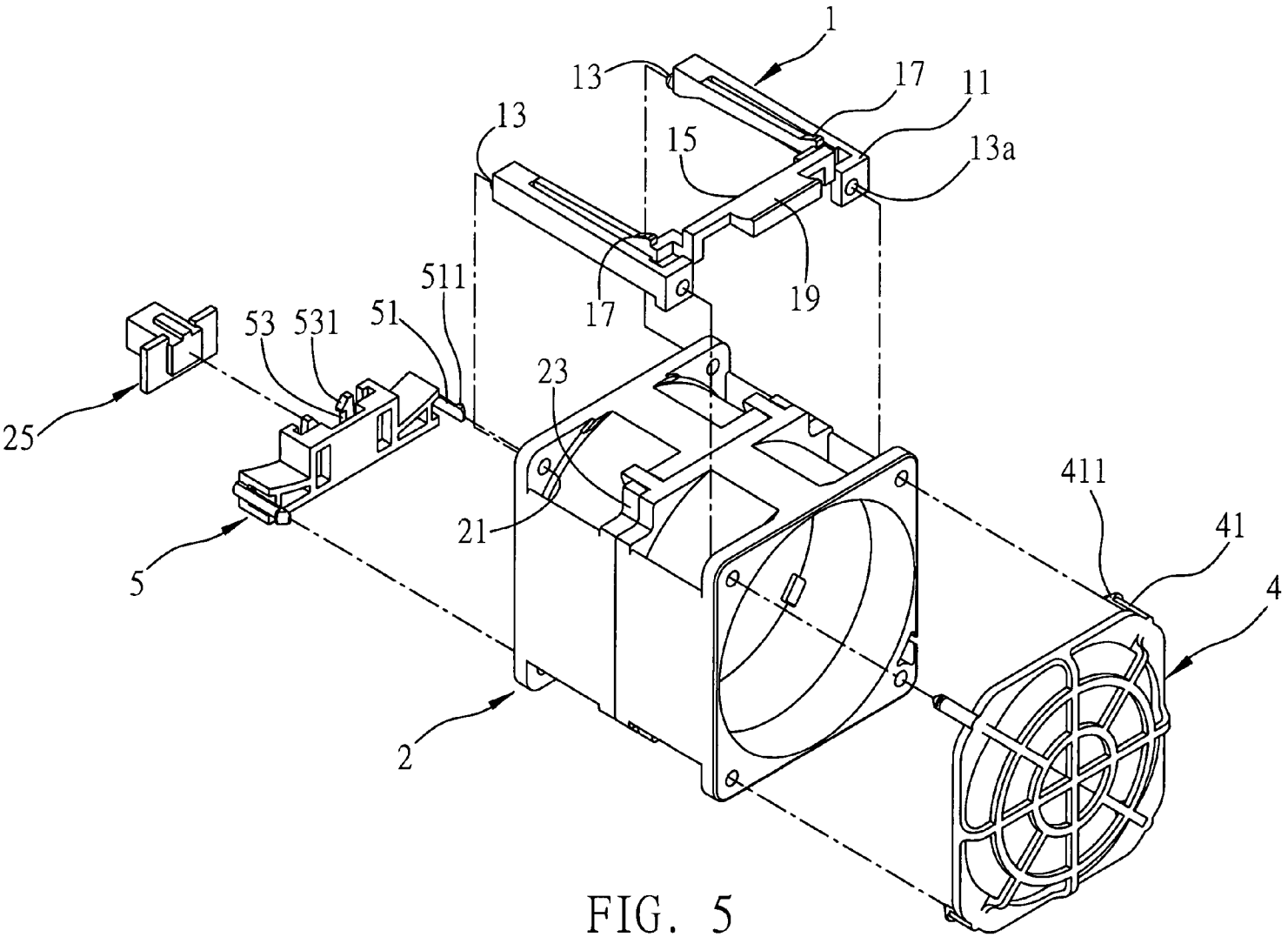
FIG. 5 shows an assembling state of the heat-dissipating module according to a second embodiment of the present invention.
Figure 6:
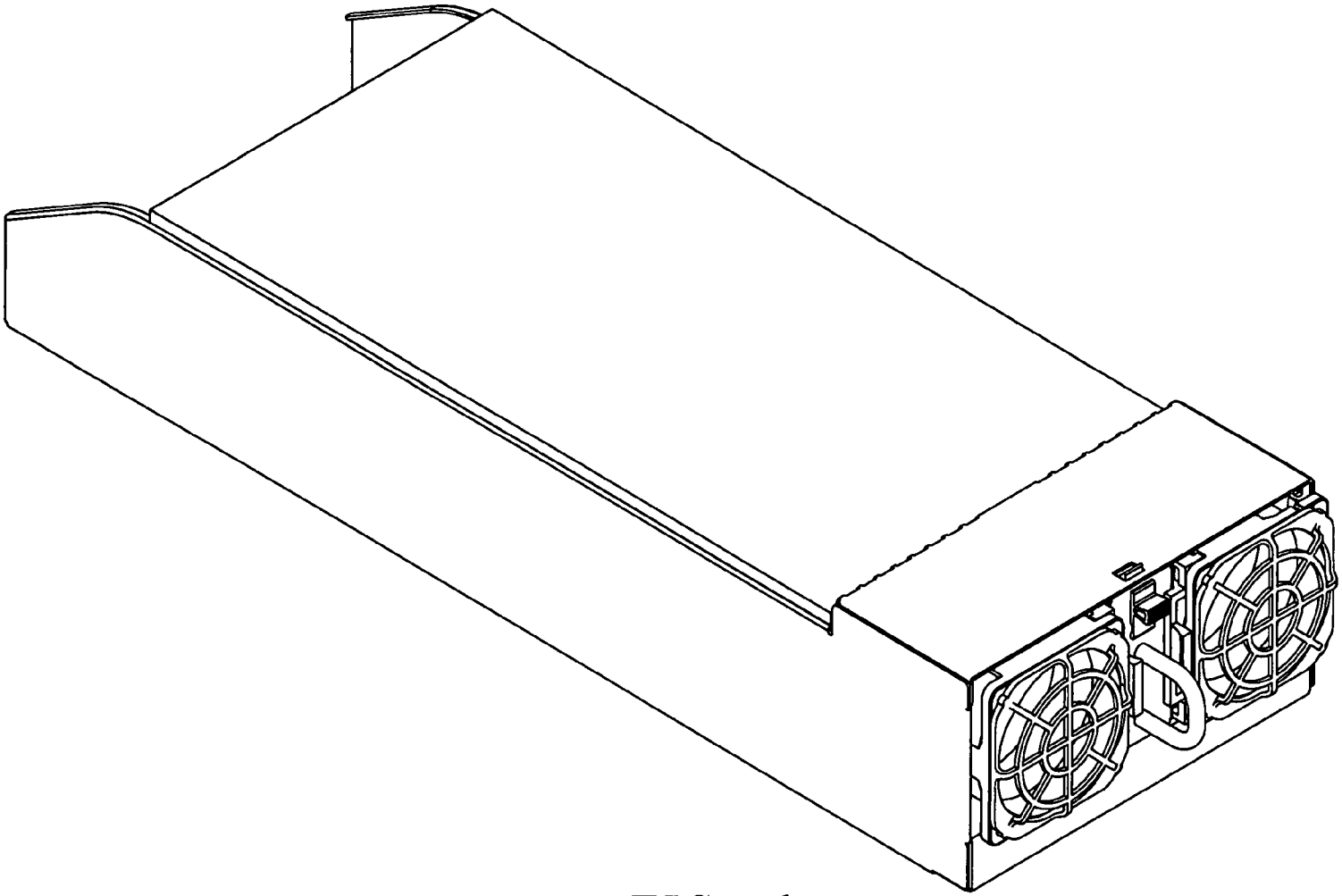
FIG. 6 is an assembly structure after the heat-dissipating module is assembled to the host housing according to the second embodiment of the present invention.

FIGS. 5 and 6 show a heat-dissipating module having the assembling member of a second embodiment according to the present invention, wherein components that are same as or similar to those in the first embodiment are denoted in symbols same as or similar to the first embodiment and detailed description of them is omitted. The main difference of the present embodiment from the first embodiment is a fan cover 4 and a power fixing structure 5 of the prior art are added to the heat-dissipating module of the present invention.

The fan cover 4 has second positioning portions 41 made of elastic columns disposed corresponding in position to the first positioning portions 21 disposed at ventilation side of the fan 2. A second engaging portion 411 made of a latch is protrudingly disposed at the end of each of the second positioning portions 41. The power fixing structure 5 comprises third positioning portions 51 disposed corresponding in position to the first positioning portions 21 disposed at the other side of the fan 2, that is, in the direction away from the fan cover, and fourth positioning portions 53 for fixing the power connector 25. The third positioning portions 51 can be made of elastic columns. A third engaging portion 511 is protrudingly disposed at the end of each of the third positioning portions 51. The fourth positioning portions 53 are elastic columns. The fourth engaging portions 531 are protrudingly disposed at the end of the fourth positioning portions 53.

To form the heat-dissipating module having the assembling member of the present embodiment, the first coupling portions 13 of the assembling member 1 are fixed to the first positioning portions 21 disposed at one side of the fan 2 and the main body 11 of the assembling member 1 is received in the receiving space 23 of the fan 2. Subsequently, the second positioning portions 41 of the fan cover 4 are inserted into the first positioning portions 21 at the ventilation side of the fan 2 and a plurality of second coupling portions 13*a* disposed at the other end of the main body 11 of the assembling member 1. The second coupling portions 13*a* are through holes corresponding to the elastic columns of the second positioning portions 41 of the fan cover 4. Through the resilient force of the second positioning portions 41, the second engaging portions 411 are engaged with the second coupling portions 13*a*. Thus, the fan cover 4 and the assembling member 1 are fixed to the fan 2.

It should be noted that the second coupling portions 13*a* are disposed corresponding in position to the second positioning portions 41 of the fan cover 4. In the present embodiment, the second coupling portions 13*a* are through holes, but it is not limited thereto.

Further, the third positioning portions 51 are inserted into the first positioning portions 21 at the other ventilation side of the fan 2, that is, disposed far away from the fan cover 4 and through the released resilient force, the third engaging portions 511 are engaged with the first positioning portions 21 of the fan 2. Thereafter, the power connector 25 of the fan 2 is disposed inside the fourth positioning portions 53. The resilient force of the third positioning portion 53 urges the fourth engaging portion 531 to be engaged with the power connector 25. Thus, a hot swap heat-dissipating module is obtained by combining the heat-dissipating module having the assembling member with conventional components, which not only prevents undesired things from entering into and damaging the fan but also is easy to assemble and disassemble.

Meanwhile, the present invention can be modified without being limited to the present embodiment. For example, both the two ventilation sides of the fan can be used in combination with the fan cover. The first coupling portions 13 can be through holes for engaging with latches disposed on the fan cover.

Therefore, the assembling member and the heat-dissipating module having the assembling member according to the present invention is easy to assemble and disassemble, has simple structure and low cost. Meanwhile, the present invention has advantage of design flexibility.

The above-described descriptions of the detailed embodiments are only to illustrate the preferred implementation according to the present invention, and it is not to limit the scope of the present invention, Accordingly, all modifications and variations completed by those with ordinary skill in the art should fall within the scope of present invention defined by the appended claims.

What is claimed is:

1. A heat-dissipating module applied in a host housing having at least a limiting portion and a plurality of first fixing portions, the heat-dissipating module comprising:

a fan having a plurality of first positioning portions and at least a receiving space formed at one side of the fan;

a fan cover disposed at a ventilation side of the fan, wherein the fan cover comprises a plurality of second positioning portions corresponding to the first positioning portions of the fan; and an assembling member comprising a main body for being accommodated into the receiving space of the fan, a plurality of first coupling portions disposed at one end of the main body for coupling with the first positioning portions of the fan, an elastic portion disposed at one side of the main body, and a plurality of first engaging portions for engaging with the first fixing portions of the host housing, the first engaging portions being connected to the elastic portions such that the first engaging portions can be urged by the elastic portions of the assembling member to engage with the first fixing portions of the host housing.

2. The heat-dissipating module of claim 1 further comprising a power fixing structure connected to a side of the fan.

3. The heat-dissipating module of claim 2, wherein the power fixing structure has a plurality of third positioning portions and a plurality of fourth positioning portions.

4. The heat-dissipating module of claim 1, wherein the heat-dissipating module has the same size as the limiting portion of the host housing.

5. The heat-dissipating module of claim 1, wherein the fan has the same size as the limiting portion of the host housing.

* * * * *